US005394651A

United States Patent [19]

Vial

[11] Patent Number: 5,394,651

[45] Date of Patent: Mar. 7, 1995

[54] FIXING DEVICE FOR AN ACTUATOR TO CONTROL THE OPENING AND CLOSING OF THE LEAF OF A DOOR OR GATE

[76] Inventor: Jean J. Vial, 213 Chemin de la Croix Blanche, 42153 Riorges, France

[21] Appl. No.: 875,236

[22] Filed: Apr. 28, 1992

[30] Foreign Application Priority Data

Mar. 17, 1992 [FR] France ..... 92 03546

[51] Int. Cl.[6] ..... E05C 17/00

[52] U.S. Cl. ..... 49/394; 49/340

[58] Field of Search ..... 49/394, 339, 340

[56] References Cited

U.S. PATENT DOCUMENTS

| | | | |
|---|---|---|---|
| 1,716,707 | 6/1929 | Schoelkopf | 49/340 X |
| 4,934,203 | 6/1990 | Bailey et al. | 49/340 X |

FOREIGN PATENT DOCUMENTS

| | | | |
|---|---|---|---|
| 2418856 | 11/1979 | France | 49/340 |
| 3615200 | 11/1987 | Germany | 49/340 |
| 2225377 | 5/1990 | United Kingdom | 49/394 |
| 684118 | 9/1979 | U.S.S.R. | 49/340 |
| 9001097 | 2/1990 | WIPO | 49/340 |

*Primary Examiner*—Peter M. Cuomo
*Assistant Examiner*—Jerry Redman
*Attorney, Agent, or Firm*—Eckert Seamans Cherin & Mellott

[57] ABSTRACT

A fixing device for an actuator to control the opening and closing of a leaf of a door or a gate has a hinged support assembly that includes a part fixed to the pillar and freely hinged at a first location to one end of the actuator, an elongated body hinged at a first end to the part fixed to the pillar and offset from the hinge of the actuator, and hingedly coupled at its other end to the distal end of the actuator, and an arm articulated at a first end to the leaf and hingedly coupled at its other end to the elongated body opposite the part fixed to the pillar. The actuator, the elongated body and the arm are substantially aligned with each other and angularly aligned with the leaf to form a triangulation in the closed position for providing angular locking of the leaf in the closed position. A hinged part of the elongated body taking the arm for coupling to the leaf is equipped with an arrangement for providing temporary locking of the leaf in an open position.

18 Claims, 9 Drawing Sheets

FIXING DEVICE FOR AN ACTUATOR TO CONTROL THE OPENING AND CLOSING OF THE LEAF OF A DOOR OR GATE

BACKGROUND OF THE INVENTION

1. Field of the Invention

This invention relates to automatic gate openers and, more particularly, to mechanical arrangements for connecting an actuator to a leaf of a gate.

2. Description of the Prior Art

The use of actuators, namely in the form of electric or other cylinders to control the opening and closing of leaves, namely for gates is well known. These cylinders can be controlled by any suitable means, namely remote controlled by a radio emitting and receiving system without this excluding other modes of control.

The body of the cylinder is generally fixed to part of the pillar where the gate is hinged, whereas the cylinder rod is coupled to the gate.

It appears that this type of cylinder fixing creates great problems on installation and often calls for the use of high capacity cylinders.

At the installation stage and in order to obtain the correct operation of the cylinder, it is essential certain dimensions are adhered to, i.e., namely the distance between the hinges of the body and the leaf concerned in two orthogonal planes.

This condition means the cylinder must be fixed at very precise locations which does not always prove to be rational depending, for example, on the structure of the gate and/or embodiment of the pillar. It is often necessary to make a cut in the pillar in order to fix the cylinder. This cut often gives rise to cracks which may appear in the pillar.

In order to avoid making this cut, in the case of a gate which is already installed, it is necessary to dismantle it to bring it closer to the front face of the pillar.

Similarly, the cylinder can only be fixed close to an edge of the pillar. Very often, given these conditions, this is likely to cause the pillar to split, since it is at the edges that such risks are most likely.

Furthermore, taking this fixing mode into consideration, it often proves very difficult to make subsequent adjustments in order to optimize, if necessary, the operation of the assembly.

It is also noted that it is necessary: to arrange a central stop, cooperating with the leaf, namely in the closing position. This stop also acts to mechanically lock the cylinder or another actuator. Besides, the leaf is submitted, when it is closed, under the thrust effect of the cylinder rod, to a tensile load which tends to create a tearing effect at the hinges. Similarly, considering the force applied by the cylinder to dose the gate and the reaction force resulting from the stop, the gate is submitted to a buckling effect.

Finally, it is necessary to highlight that the installation of the cylinder, directly onto the pillar and leaf, proves to be both long and delicate and calls for the strict adherence to the dimensions provided by the manufacturer, likely to guarantee the correct operation of the cylinder.

SUMMARY OF THE INVENTION

The invention is aimed at overcoming these disadvantages in a simple and efficient manner.

The problem the invention intends to solve is to facilitate the fixing of an actuator, or cylinder, having a fixed body and a mobile rod and improve its fixing conditions by aiming to reduce, in a known manner, the fitting time and improve the operating conditions of the cylinder, thereby providing a greater choice with the possibility of reducing its characteristics for the equivalent operations and performances, thus reducing the costs.

In order to solve this type of problem, an actuator or cylinder fixing device was designed and includes a hinged support assembly made up of several components likely to provide the fixing of the cylinder firstly, to the part where the leaf is mounted, namely the pillar, and, secondly, the leaf itself, the assembly being designed to angularly lock the leaf in the open and closed positions whilst adhering to the functional dimensions of the cylinder stroke.

In an advantageous manner the problem brought up is overcome in that the support assembly includes a preferably rectilinear, elongated body hinged at one end to a bracket, fixed onto the pillar, the bracket, taking, in a distinct manner and freely hinged, one of the fixed part and the mobile part of the cylinder whereas the second end of the elongated body takes the other of the fixed part and the mobile parts of the actuator and is adapted for the hinged assembly of an arm for coupling to the leaf.

In order to overcome the problem brought up of providing mechanical locking in the closed position, namely without submitting the cylinder to stresses, the arm is hinged at the second end of the elongated body, the hinge pin of the arm being offset from the plane defined by the fastening point of the other of the fixed part and the mobile part.

The arm has a yoke or other means, hinged in a fixed member, laterally projecting from the second end of the elongated body and acting as a stop of the leaf in the closed position corresponding to the alignment of the elongated body and arm.

In order to overcome the problem brought up of fixing the cylinder in the best possible conditions, namely avoiding any risk of the pillar from splitting, the bracket fixed on the pillar has a first projecting lug for the hinging of the one of the fixed part and the mobile part of the cylinder and a second lug for the hinging of the elongated body, the lugs being situated in the same horizontal plane and of different lengths in order to offset the fixing of the cylinder and elongated body.

Another problem the invention intends to overcome is to provide optimum operation of the cylinder in all cases, i.e. regardless of the design or structure of the gate or pillar and regardless of the desired opening angle of the gate, even beyond 90°.

This type of problem is overcome in that the angle defined, firstly, by a fictitious straight line going through the rotational axis of the leaf and the end of the said elongated body and, secondly, the arm hinged at the end of the said elongated body and on the leaf, is greater than the angle defined by the elongated body and the cylinder.

Besides, the invention intends to overcome the following problems in a significant manner:

- to control the opening of the gate up to the desired point
- to prevent the gate from closing again under the effect of the wind or any thrust, when the cylinder used does not lock in the opening position, i.e. its rod in the closed position. However, in general, the cylinders used are of the non-locking type due to their low cost to simplify the mechanical locking of the leaf in the closing position.

In order to overcome these various problems, the hinge part of the body taking the arm for coupling to the leaf is equipped with an arrangement for providing temporary locking of the said leaf in an angular opening position.

In a first embodiment, the arrangement for providing temporary locking is controlled by the actuator rod, the fastening point of which is mounted, capable of movement in translation, limited in a support yoke integral to the body, and taking the rod.

In a second embodiment, the arrangement for providing temporary locking is servo-controlled by a system fixed to an automation for controlling opening and closing of the leaf.

In the event where the arrangement for providing temporary locking is controlled by the acuator rod, the latter are made up of a disk integral to the coupling arm, so as to be angularly driven, in a simultaneous manner, the disk having arrangements cooperating with the complementary part of a hinged drive assembly urged by the fastening point of the actuator rod.

Another problem the invention intends to overcome is to be able to temporarily inhibit the locking device.

This type of problem is overcome in that the hinged drive assembly makes up a bent arm with one part projecting from the support yoke, so as to be manually urged, with a view to coupling or not coupling the arrangements of the disk and the hinged drive assembly.

In the event where the arrangement for providing temporary locking is controlled by the automation to control the opening and closing of the leaf, the arrangements of the disk are made up of a nose formed by projecting from its periphery and likely to cooperate with a lever hinged inside the body so as to be directly urged by the system fixed to the automation.

In order to overcome the problem brought up of urging the arrangement for providing temporary locking under the movement of the actuator rod, the latter is coupled in a yoke by means of a pin mounted in a slot.

In order to overcome the problem brought up of simplifying the mechanical locking of the leaf in the closing position, the coupling arm is applied against the rectilinear elongated body creating a toggle effect.

BRIEF DESCRIPTION OF THE DRAWINGS

The invention is now described in more detail with the aid of the appended drawings, in which.

DESCRIPTION OF THE PREFERRED EMBODIMENTS

Figure 1:
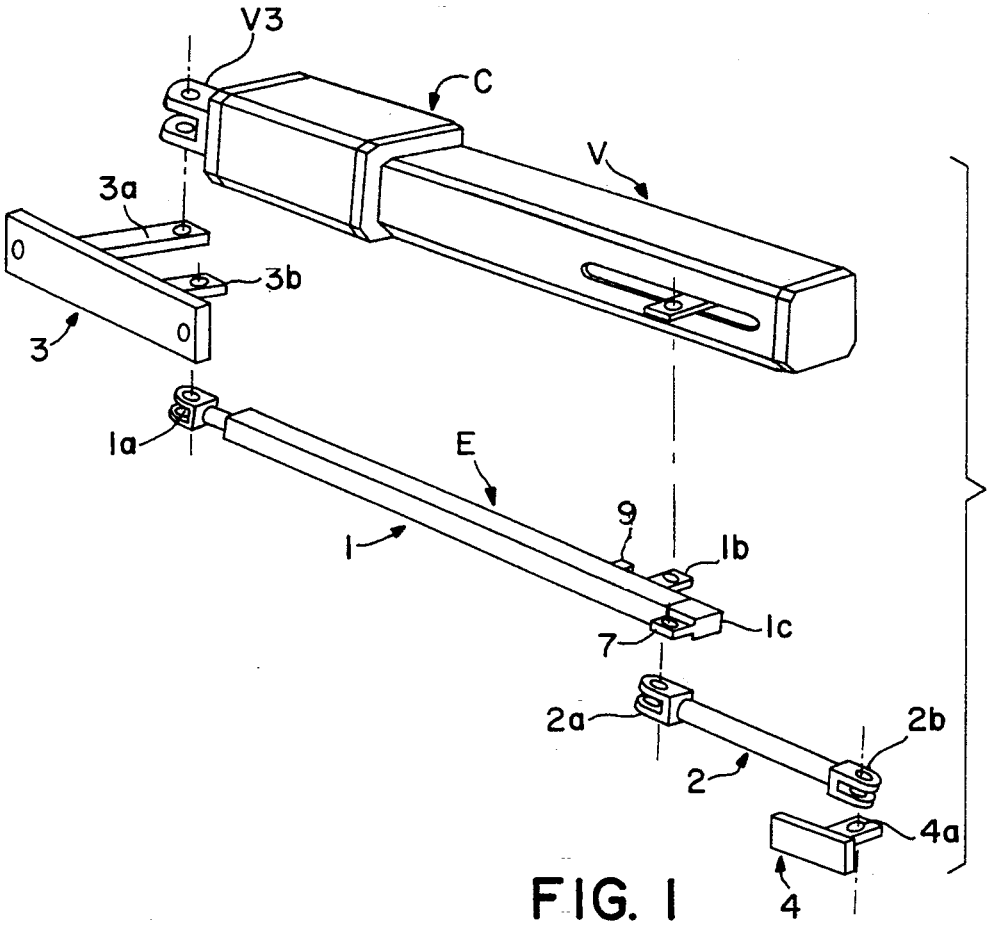
FIG. 1 is a perspective view, before mounting the main components of the cylinder fixing device.

As indicated, the device most particularly applies to the fixing of any type of cylinder, or actuator, in order to control the opening and closing of one or several leaves. Namely, the invention has a particularly advantageous application, in the case of a gate (P) mounted and freely hinged on the pillars (PL).

The cylinder, described as (V), is of any known and suitable type, with a mobile part, or rod (V1) and a fixed part, or body (V2). The cylinder assembly can be advantageously arranged inside a casing (C).

According to the invention, the device includes a hinged support assembly designed to fixing the cylinder (V), firstly, to the pillar, and, secondly, the leaf of the gate (P).

For the main part, this support assembly includes a preferably rectilinear, elongated body (1), an arm (2) and first and second brackets (3) and (4) designed to be at the pillar and gate respectively.

The bracket (3) takes, in a distinct manner, freely hinged, firstly, the body (1) and, secondly, the cylinder (V). With this aim, the fixing component (3) has a first projecting lug (3*a*) to fix the elongated body of the cylinder, by means for example of a yoke (V3). In a manner parallel to the lug (3*a*) and in the same horizontal plane, the bracket (3) has a second lug (3*b*), generally shorter than the lug (3*a*) for the hinging of one end (1*a*) of the elongated body (1). It therefore appears that the elongated body (1) and cylinder are situated in the same plane whilst being offset.

The end of the rod (V1) of the cylinder (V) is coupled in a hinged manner to a projecting lug (1*b*) formed the other end of the body (1) opposite its hinge (1*a*) on lug (3*a*).

Obviously, an inverse fixing of the cylinder on the support assembly is not excluded, i.e. coupling of the rod at the bracket (3) and coupling of the elongated body at the end (1*a*) of the elongated body (1).

According to another characteristic, the end of the elongated body (1), at the hinge lug (1*b*) is designed to take, with free hinging, the arm (2). At the opposite end, arm (2) is hinged on the fixing component (4) designed to be coupled to the gate.

Figure 4:
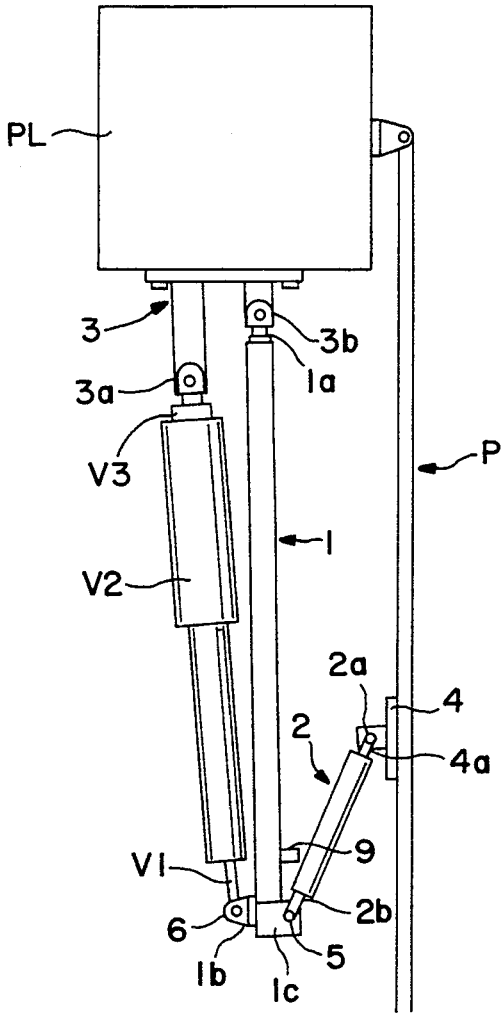
FIG. 4 is a plan view corresponding to FIG. 2 showing the device of the leaf in the opening position at 90°.
Figure 5:
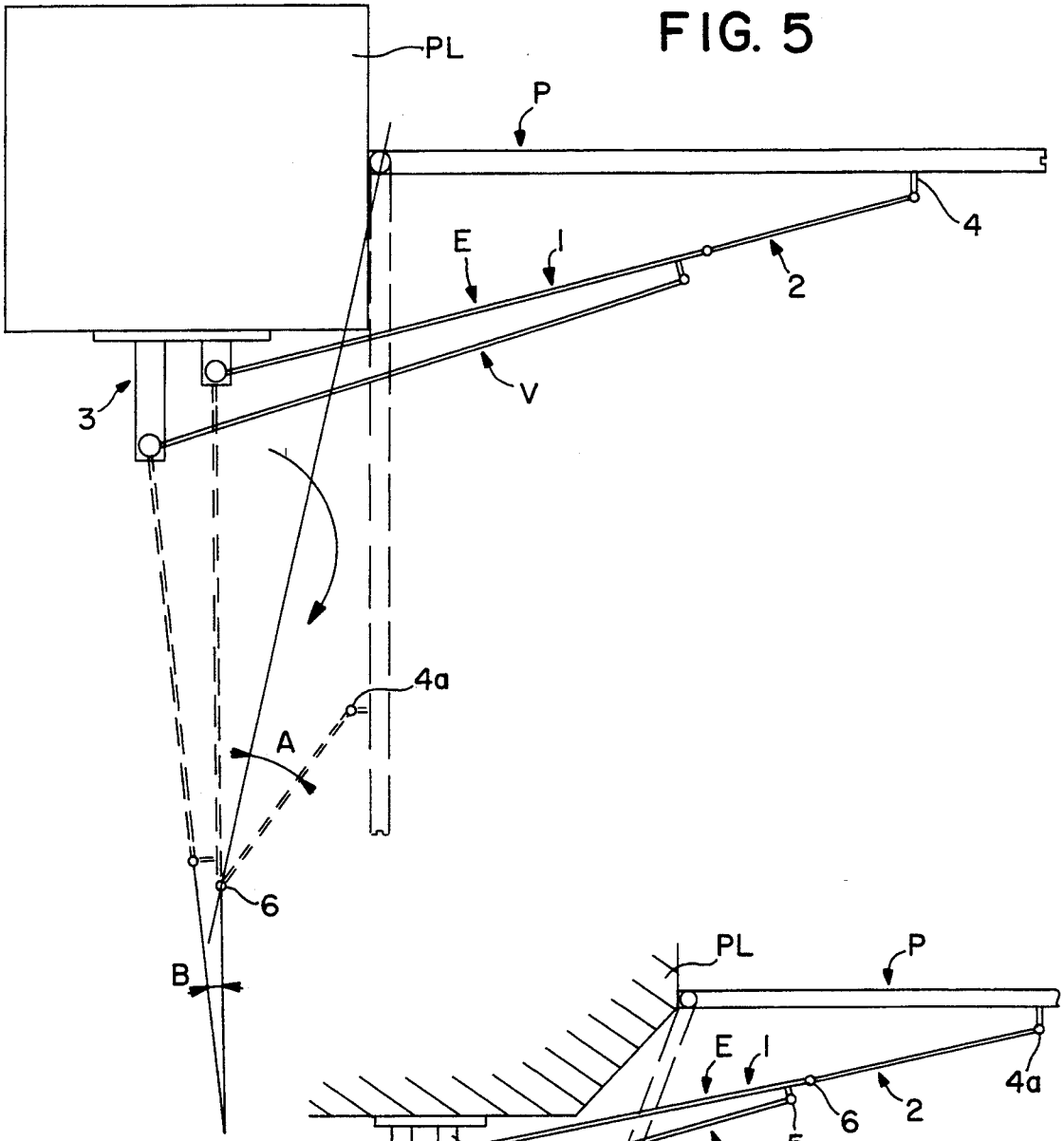
FIG. 5 is a schematic plan view showing the operating principle of the fixing device of leaf in the opening and closing position.

Considering these arrangements, it therefore appears that the cylinder (V), namely its body (V2), is fixed at the pillar by means of the lug (3*a*) whereas its rod is fixed to the leaf by means of arm (2) hinged at the end of the body (1), itself hinged to the lug (3*a*)(FIG. 4).

Figure 2:
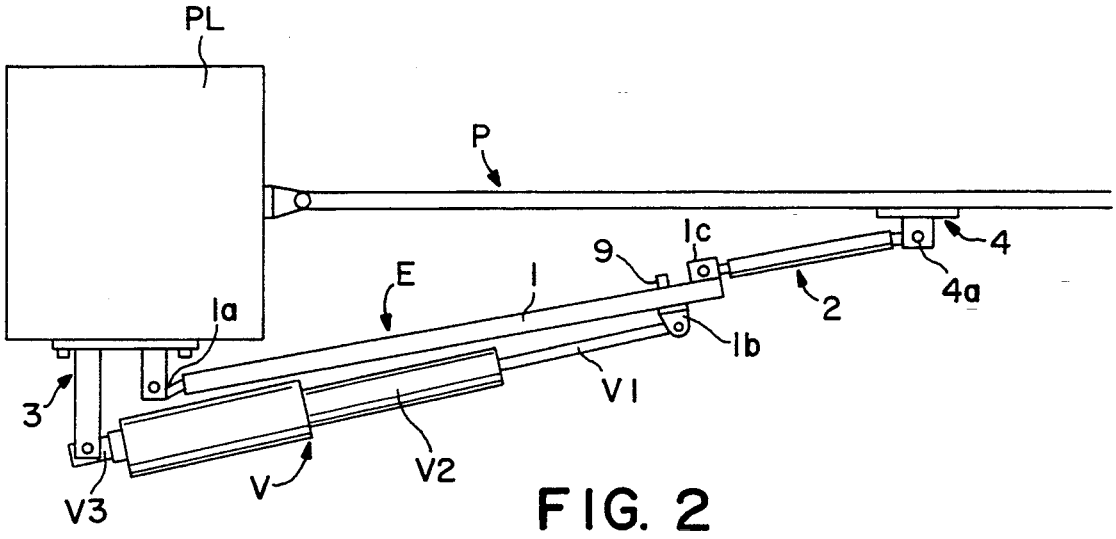
FIG. 2 is a plan view showing the fixing device of the leaf in the closing position.

In a significant manner, the hinge pin (5) of arm (2) on elongated body (1), is offset from the plane defined by the fastening point (6) of the cylinder rod on elongated body (1). This proves particularly important, in order to solve one of the problems brought up of providing mechanical locking by means of the fixing device. With this aim in mind, arm (2) has a yoke (2*a*) hinged in a fixed member, or hinged offset part (7), laterally projecting from the end of the elongated body (1) so as to act as a stop for the leaf in the closing position. In this position, as shown namely in FIG. 2, the elongated body (1) and arm (2) are arranged in the same alignment. It is apparent from inspection of the arrangement shown in FIG. 2 that in the closed position the leaf (P) is restricted from extending past the closed position by any further extension of the elongated body (1) and the arm (2).

It is to be noted that the other end of the pin (2) can also have a yoke (2*b*) so as to be hinged onto a lug (4*a*) of the second bracket (4).

However, it is not excluded to arrange the hinge pin (5) of arm (2) in the same alignment as the elongated body.

Figure 3:
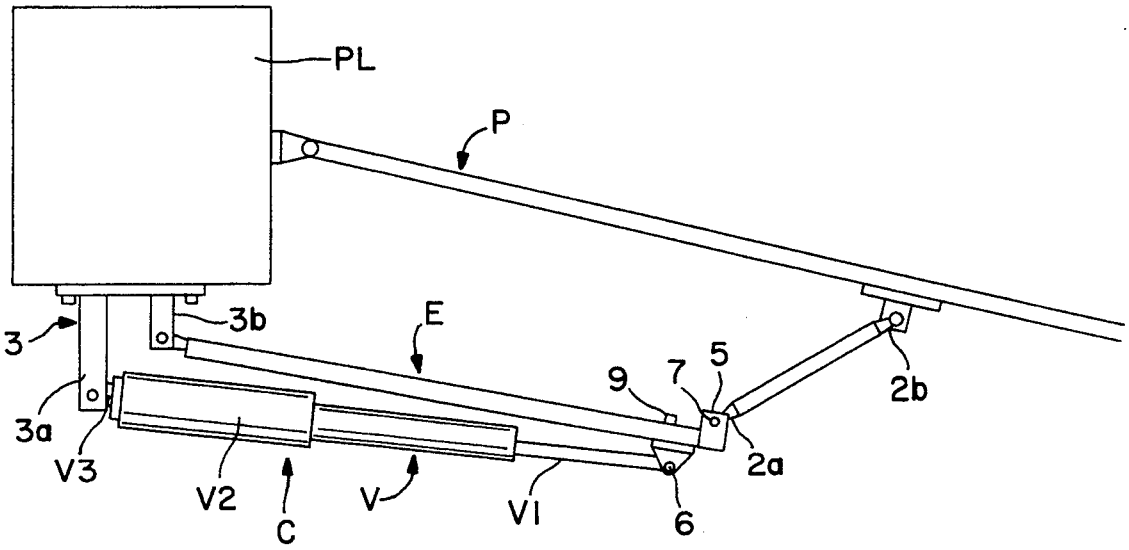
FIG. 3 is a plan view corresponding to FIG. 2 showing the device in the process of opening the leaf.

As and when the gate shuts (FIGS. 4, 3 and 2), under the thrust effect of the cylinder rod, the hinged arm angularly and gradually moves the said gate, until its yoke (2*a*) is in the abutting position with the offset part (7) of the elongated body (1) corresponding to the alignment of the said arm and the said elongated body and the closed position of the gate. According to another important characteristic of the invention, the gate in the open position, the angle (A) defined, firstly by a fictitious straight line going through the rotational axis of the leaf and the end of the elongated body (1) and, secondly, the arm (2) hinged at the end of the said elongated body and on the leaf, is greater than the angle (B) defined by the elongated body (1) and cylinder (V). In order for this condition to be always respected, regardless of the opening angle of the gate, it is planned to arrange at the end of the elongated body (1), close to the hinge part (7), a component (9) acting as a stop with the arm (2)(FIG. 4). This stop (9) can be adjustable.

In order to overcome the problem brought up of taking the different structures of gates and dimensional deviations likely to result from this, into account, the arm (2) is designed of several independent components, capable of being adjusted and locked at the required length.

The fixing of the cylinder or another actuator, with the device according to the invention, is particularly simple and is carried out, on the whole, as described below:

- the first bracket (3) is generally positioned on the front face of the pillar, at a certain distance from the floor, furthermore, this part is positioned so that the lug (3*b*), on which the elongated body (1) is hinged, is situated at a distance approximately 170 mm from the edge of the pillar but capable of going up to 500 mm or more. It is to be pointed out that first bracket (3) is substantially situated in the center line of the pillar, thereby preventing any risk of damage to the edges of the latter.
- The elongated body (1) is positioned and fixed onto the lug (3*b*).
- By means of its yoke (2*a*), the arm (2) is coupled to the hinged offset part (7) formed at the end of the elongated body (1).
- The fixing second bracket (4) is positioned on the gate after being coupled to the end of arm (2).
- The hinged assembly including of the body (1) and arm (2) are positioned on the gate and second bracket (4) is temporarily fixed.
- The cylinder is positioned and fixed both to the lug (3*a*) and end (1*a*) of elongated body (1) after unlocking and taking out the rod.
- The hinged assembly is operated manually, the rod of the cylinder being unlocked to check the total opening of the gate.
- The connecting piece (4) is fixed in a final manner, and, depending on the type of actuator, the sufficient hydraulic or mechanical pressure is applied to ensure the correct operation of the cylinder or other means.

It is to be noted that the elongated body (1) can be advantageously but not limitatively, made from a square section tube, whereas the arm (2) can be made by means of round tubes.

According to an important characteristic of the invention, in the embodiment illustrated in FIGS. 8 to 13, the arrangement for providing the temporary locking of the leaf in the angular opening position, i.e. with the rod (V1) of the cylinder (V), retracted, are controlled by the said rod (V1). With this aim in mind, the coupling arm (2) is integral at its hinge (5), on the lug (1*c*), to a disk (10), so as to be driven in a simultaneous manner, during the angular movement of the arm (2) urged by the cylinder. This disk (10) has arrangements for cooperating with the complementary parts of a hinged lock assembly (11).

As shall be specified in the following description, the hinged lock assembly (11) is urged by the rod (V1), namely by its hinge point (6). With this in mind, the hinge pin (6) is mounted in a slot (1*b*1) formed in the yoke (1*b*) so as to be moved in translation urged by the rod.

Figure 8:
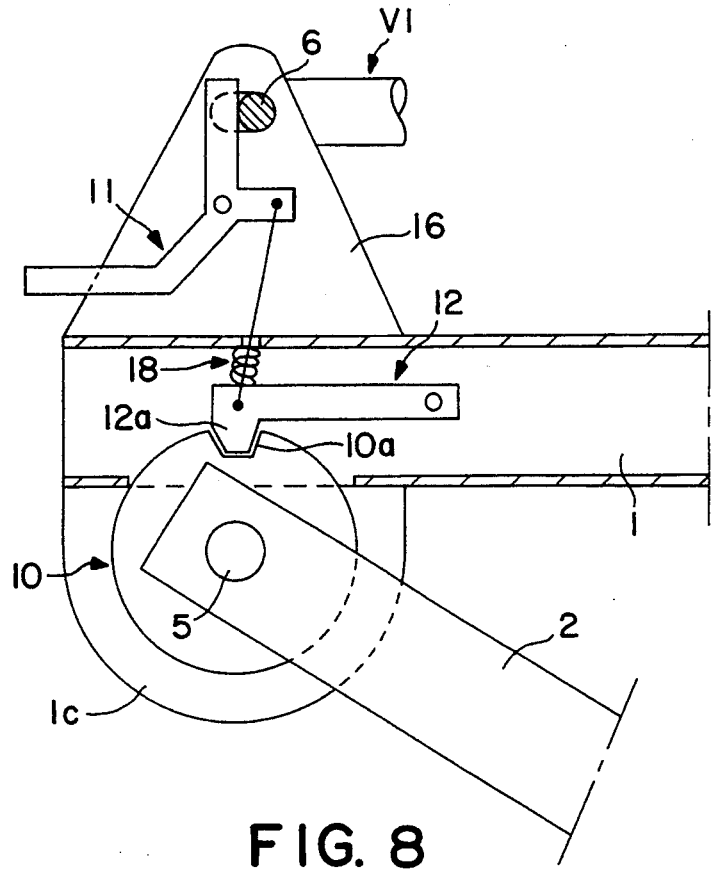
FIG. 8 is a plan sectional view of the hinge of the body and coupling arm, in a first embodiment, of the temporary locking arrangement urged by the actuator rod, the device being shown of the leaf locked in the open position.
Figure 9:
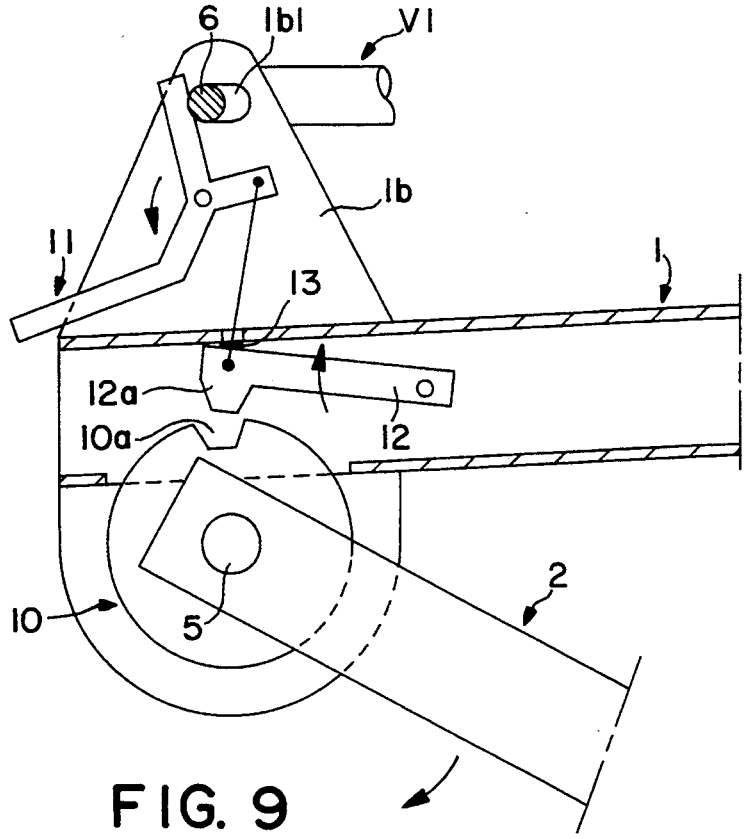
FIG. 9 is a view corresponding to FIG. 8 with the device in the unlocked position.

In the embodiment illustrated in FIGS. 8 and 9, the disk (10) has a notch (10*a*) likely to cooperate with a lever (12) hinged inside the body (1) and coupled to assembly (11) mounted in the support yoke (1*b*) taking the rod (V1) of cylinder (V). The lever is maintained applied against the periphery of the disk (10) by elastic means (13).

Figure 7:
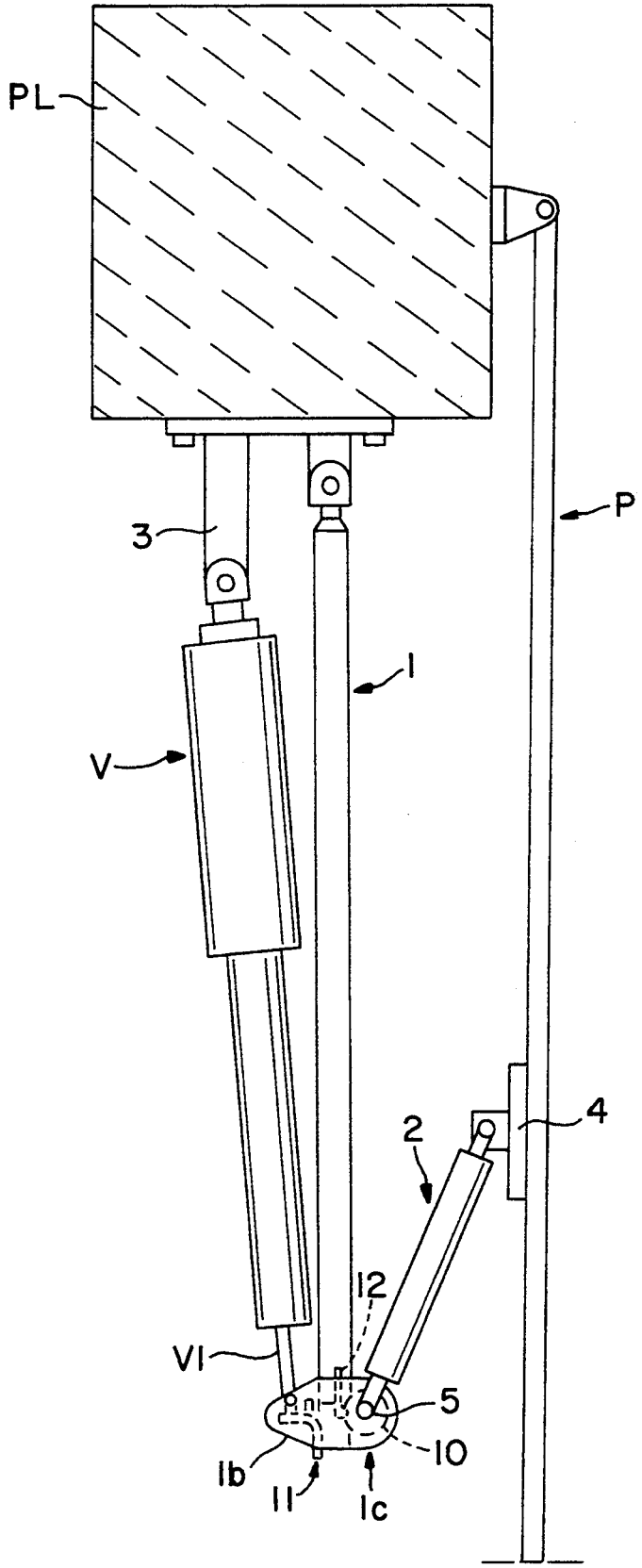
FIG. 7 is a top view showing a gate leaf in the opening position, fixed onto the pillar by means of the device, the hinge part of the body of which is equipped with the arrangement for providing temporary locking of the leaf in the angular opening position.

It therefore appears that when the cylinder (V) is actuated in order to apply a tensile load to its rod (V1), the hinged lock assembly, body (1)-arm (2) cause the leaf of the gate (P) to open (FIG. 7). At the end of the opening, the nose (12*a*) of the lever (12) is inserted in the notch (10*a*) of the disk (10)(FIG. 8). Therefore there is mechanical locking of the arm (2) with respect to the body (1) and consequently, the leaf in the opening position. The rod (V1) of the cylinder is therefore indirectly locked in translation.

When the cylinder (V) is actuated in the opposite direction, the rod (V1) applies a thrust and causes, urged by the movement of its hinge pin (6), in the slot (1*b*1) of the yoke (1*b*), the angular tipping of the assembly (11) which, in a simultaneous manner, releases the lever (12) considering it is coupled to the assembly (FIG. 9). As the disk is not locked in rotation, the arm (2) can once again be angularly moved to close the gate.

Figure 10:
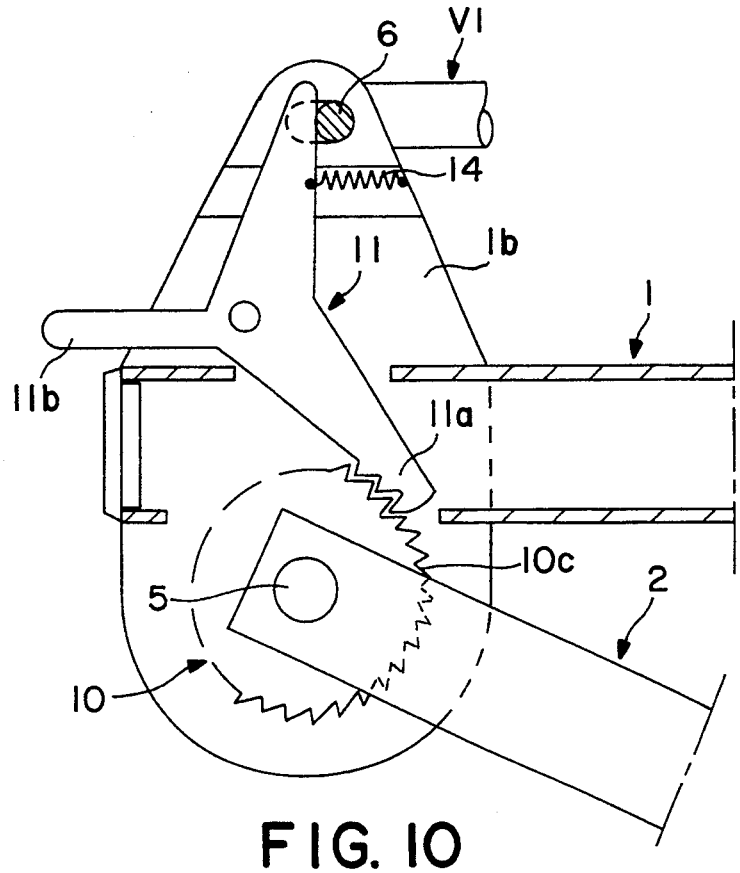
FIG. 10 is a view similar to FIG. 8, showing another embodiment of the arrangements of the disk.
Figure 11:
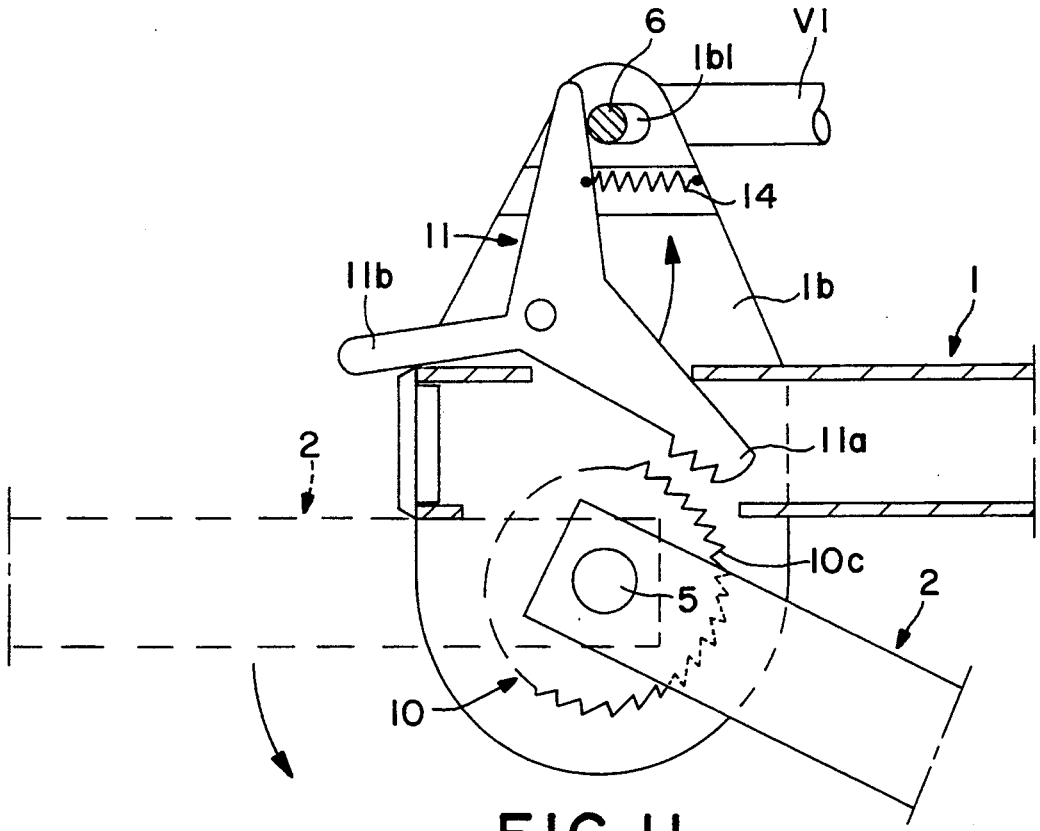
FIG. 11 is a view corresponding to FIG. 10 with the device in the unlocked position.

In the embodiment illustrated in FIGS. 10 and 11, the disk (10) has, over all or part of its periphery, teeth (10*c*) likely to cooperate with complementary teeth (11*a*) on the hinged assembly (11). In this embodiment, assembly (11) is kept applied against the periphery of the disk (10), with the teeth (11*a*)(10*c*) in the meshing position, by elastic means (14). It is to be noted that the profiles of the teeth are determined so as to provide free rotation of the disk, during angular swivelling of the arm (2), corresponding to the opening of the gate urged by the tensile load of the cylinder rod.

Alternatively, when the desired open position is reached, the disk (10) and consequently arm (2) are locked in rotation by the hinged assembly (11).

As in the previous embodiment, when the cylinder (V) is actuated in the opposite direction, the rod (V1) applies a thrust and causes, urged by the movement of its hinge pin (6), in the slot (1*b*1) of the yoke (1*b*), the angular tipping of the assembly (11), which, in a simultaneous manner, releases the teeth (11*a*)(FIG. 11). As the disk is no longer locked in rotation, the arm (2) can be once again angularly moved to close the gate.

Figure 6:
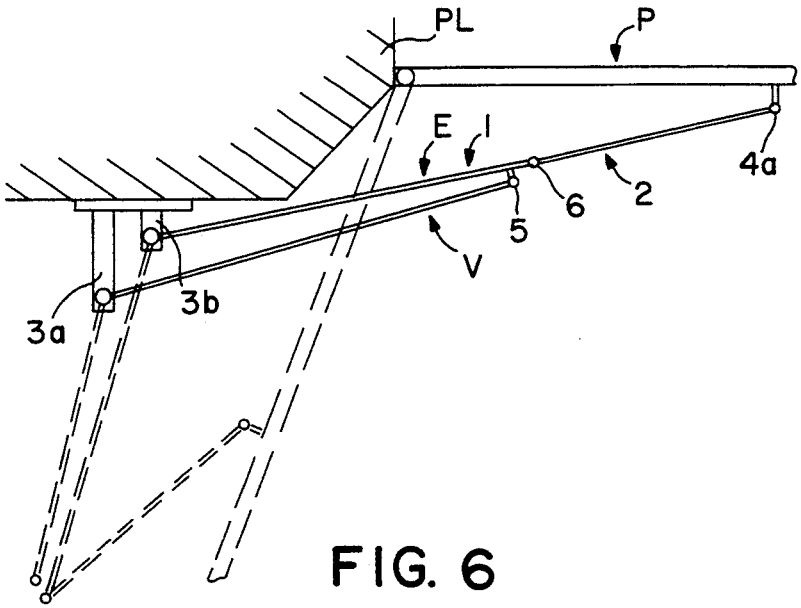
FIG. 6 is a schematic view in the case of an application of the device to open the leaf beyond 90° (lines of dashes).

In the embodiment illustrated in FIGS. 6 and 7, the disk (10) cooperates with a lever (15) acting as a cam and hinged inside the body (1). This lever (15) is coupled to assembly (11) mounted in the support yoke (1*b*) taking the rod (V1) of the cylinder (V). The lever (15) is maintained applied against the periphery of the disk (10) by elastic means (16).

It is to be noted that the lever (15) is determined to provide the free rotation of the disk during angular swivelling of the arm (2), corresponding to the operation of the gate under a tensile load from the cylinder rod.

Figure 12:
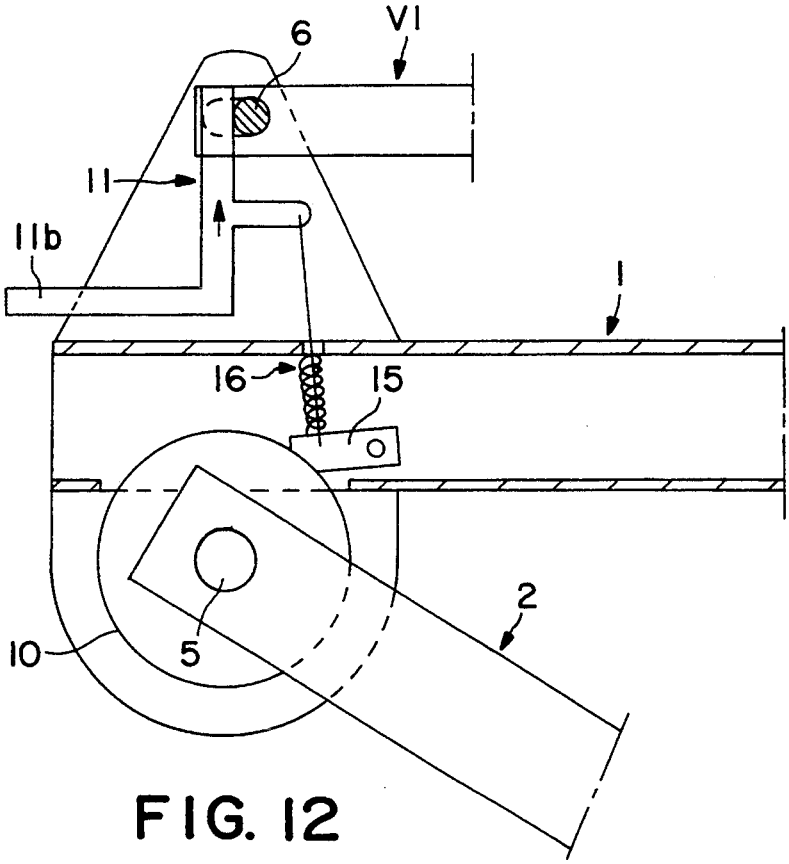
FIG. 12 is a view similar to FIG. 8, showing another embodiment of the arrangements of the disk.

Alternatively, when the maximum open position is reached, the disk (10) and consequently the arm (2), are locked in rotation by the profile of the lever acting as a cam (15)(FIG. 12).

Figure 13:
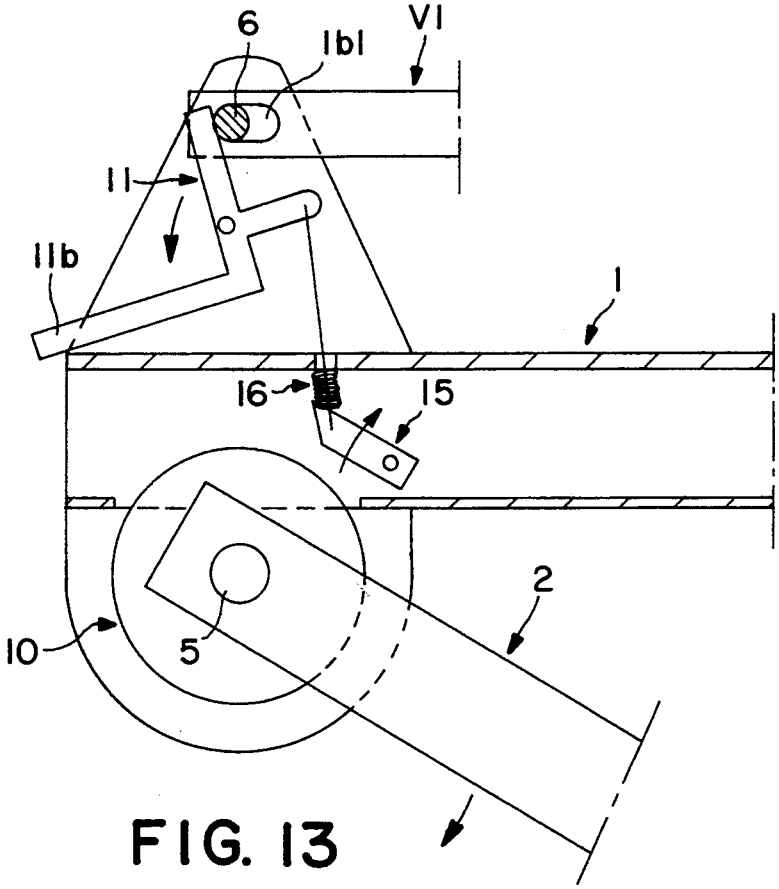
FIG. 13 is a view corresponding to FIG. 12 with the device in the unlocked position.

When the cylinder (V) is actuated in the opposite direction, the rod (V1) applies a thrust effect and causes, urged by the movement of its hinge pin (6), in the slot (1*b*1) of yoke (1*b*), the angular tipping of assembly (11), which, in a simultaneous manner, releases the lever (15)(FIG. 13). As the disk is no longer locked in rotation, the arm (2) can once again be angularly moved to close the gate.

In the embodiments illustrated in FIGS. 8, 9, 10, 11, 12 and 13, the hinged lock assembly (11) makes up a lever suitably profiled and bent to have a part (11*b*) which projects from the yoke (1*b*). This part (11*b*) can be actuated manully, so as to tip the lever (11) and consequently, replace, the effect of the cylinder rod. These arrangements prove to be valuable, in the case, for example, of anomalies of operation of the cylinder, which enables the disk (10)-arm (2) assembly to be unlocked.

Figure 14:
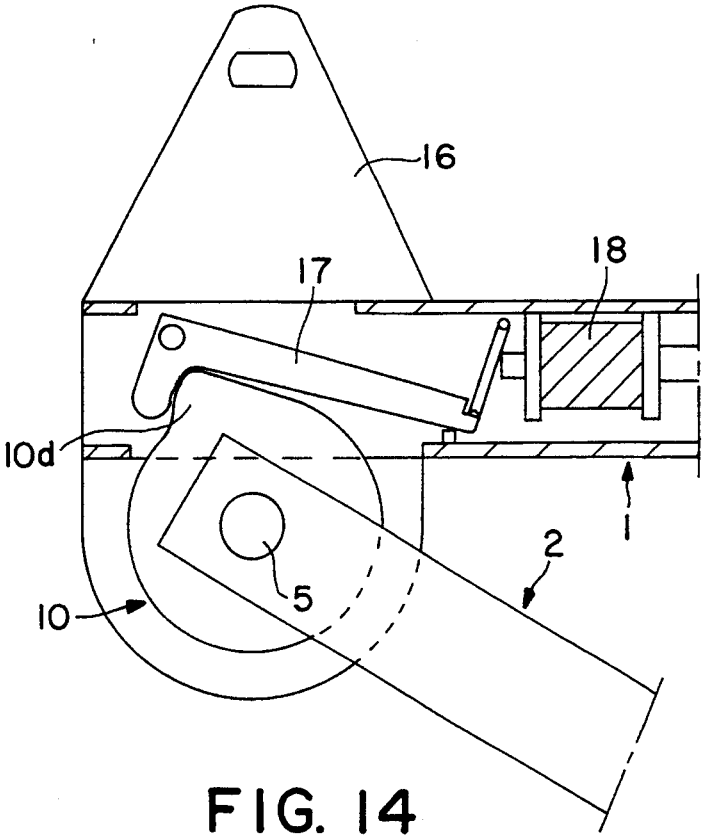
FIG. 14 is a plan, sectional view of the hinge of the body and coupling arm, in which the arrangement for providing temporary locking is urged by a system fixed to the automation to control the opening and closing of the leaf, the device being shown locked in the opened position.
Figure 15:
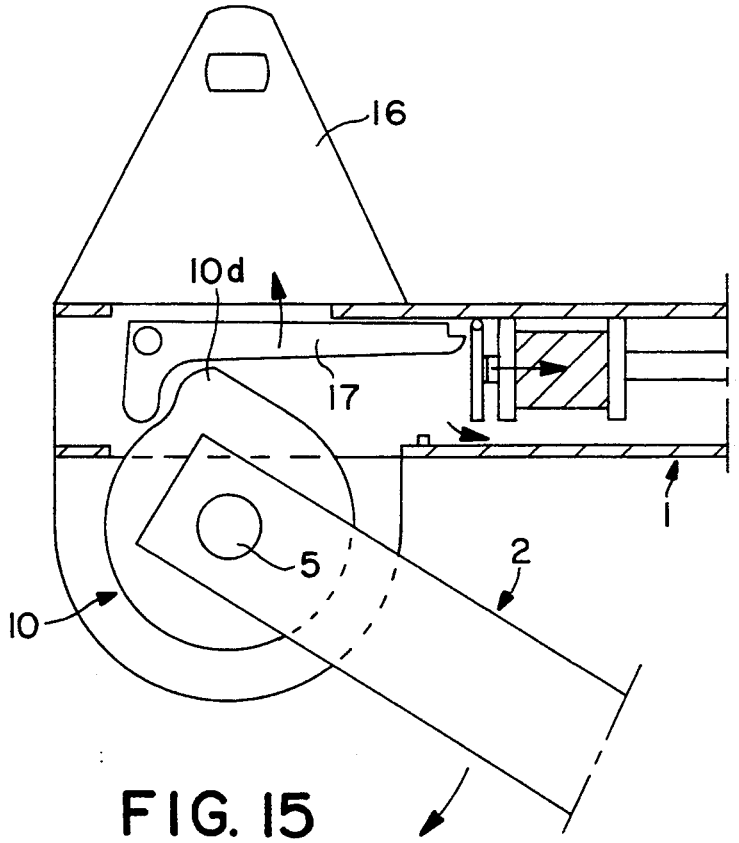
FIG. 15 is a view corresponding to FIG. 14 with the device in the unlocked position.
Figure 16:
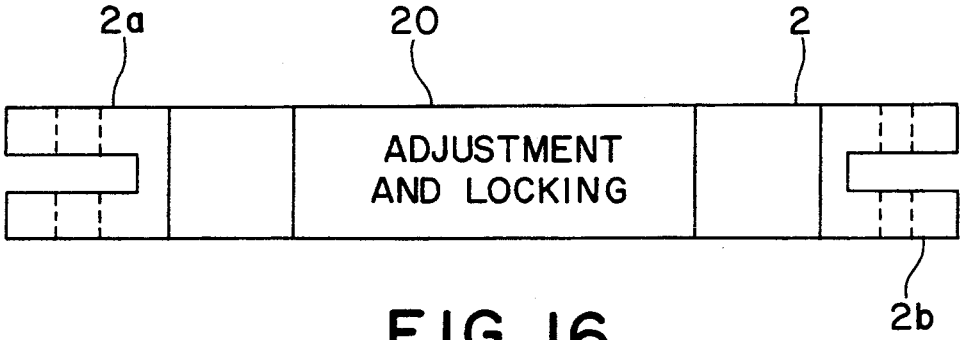
FIG. 16 is an elevation view of an embodiment of the arm wherein the length of the arm is adjustable.

In FIGS. 14 and 15, the assembly for temporarily locking the gate in the open position, are servocontrolled by a system fixed to the automation to control the opening and closing of the gate.

With this aim in mind, the disk (10) has a nose (10*d*) formed by projecting from this periphery. This nose is designed to cooperate with a lever (17) hinged inside the body (1). This lever (17) is designed to be directly urged by a system, such as an electromagnet (18) fixed to the control automation of the gate. The operation remains identical to that of the previous embodiments.

FIG. 14 showing the locking of the disk (10)-arm (2) assembly in the angular open position, the nose (10*d*) being abutted against a bent part of the lever (17). In FIG. 15, as the electromagnet is actuated, the lever (17) is cleared away, thereby freeing the nose of the disk (10).

In a significant manner, according to the invention, the gate in the closed position, the coupling arm (2) is applied against the rectilinear body (1) thereby creating a toggle effect (line of dashes)(FIG. 11).

The advantages are made well apparent from the description, the following is particularly highlighted and reminded:

- The fixing of the cylinder by means of the assembly substantially hinged in the central part of the pillar, thereby substantially reducing any risk of splitting.
- The mechanical locking of the gate enabling the central stop to be suppressed and the use of a non-locking cylinder, thereby preventing any risk of the gate buckling.
- The gate is not submitted to thrust or tensile loads likely to generate weakening at its hinges.
- The hinged support assembly demultiplies the load, so that the cylinder operates with lower thrust and tensile pressures.
- The simple and quick installation.
- No modification of the adjustments with time, due to possible play at the gate hinge.

Whereas particular embodiments of the present invention have been described above for purposes of illustration, it will be appreciated by those skilled in the art that numerous variations of the details may be made without departing from the invention as described in the appended claims.

I claim:

1. A fixing device for an actuator which controls movement of a leaf of a gate between an open position and a closed position, the actuator comprising a fixed part and a mobile part, the leaf being hingedly mounted on a pillar, the fixing device comprising a hinged assembly including:

a hinge bracket fixed to the pillar;

one of the fixed part and the mobile part of the actuator being hingedly coupled to the hinge bracket at a first location;

an elongated body, including a first end hingedly coupled to the hinge bracket at a second location distinct from the first location, and hingedly coupled near a second end to the other of the fixed part and the mobile part of the actuator; and an arm hingedly coupled at a first end to the leaf and hingedly coupled at a second end to the elongated body near the second end of the elongated body, the elongated body and the arm being aligned with each other and each being angularly aligned with the leaf in the closed position, wherein the leaf is stopped from moving beyond the closed position by any further extension of the elongated body and the second arm.

2. The device according to claim 1, wherein a hinge pin of the arm coupling the arm to the elongated body is offset from a plane defined by a fastening point of the other of the mobile part and the fixed part of the actuator to the elongated body.

3. The device according to claim 2, in which the arm has a yoke hinged in a fixed member, laterally projecting from the second end of the elongated body and acting as a stop when the leak is in the closed position.

4. The device according to claim 1, in which the bracket has a first projecting lug for hinging to the one of the fixed part and the mobile part of the actuator and a second projecting lug for hinging to the elongated body, the first projecting lug and the second projecting lug being situated in the same horizontal plane and of unequal lengths to offset the actuator and the elongated body.

5. The device according to claim 1, wherein a first angle defined, firstly, by a straight line going through a rotational axis of the leaf and the second end of the elongated body, and secondly, by the arm, is greater than a second angle defined by the elongated body and the actuator in the open position.

6. The device according to claim 5, in which a component acting as a stop and for cooperating with the arm in the open position, is fixed to the elongated body proximate a location at which the arm is hingedly coupled to the elongated body.

7. The device according to claim 1, in which the arm comprises a plurality of independent components capable of adjustment and locking at a required length.

8. The device according to claim 1, in which the first end of the arm has a yoke hinged on a second bracket fixed onto the leaf.

9. The device according to claim 1, wherein a hinge part of the elongated body taking the arm for coupling to the leaf comprises means for providing temporary locking of the leaf in the open position.

10. The device according to claim 9, wherein the means for providing temporary locking of the leaf is controlled by the mobile part, a fastening point of which is mounted capable of limited movement in translation, in a support yoke integral to the elongated body.

11. The device according to claim 10, in which the means for providing temporary locking of the leaf comprises a disk integral to the arm so as to be angularly driven in a simultaneous manner with the arm, the disk having arrangements cooperating with complementary arrangements of a hinged lock assembly.

12. The device according to claim 11, in which the arrangements of the disk comprise a notch cooperating with a lever inside the elongated body and coupled to the hinged lock assembly in the support yoke so as to be angularly urged by the fastening point of the mobile part.

13. The device according to claim 11, in which the arrangements of the disk comprise teeth which cooperate with complementary teeth on the hinged lock assembly in the support yoke so as to be angularly urged by the fastening point of the mobile part.

14. The device according to claim 11, in which the arrangements of the disk comprise a periphery, cooperating with a lever acting as a cam, hinged to the elongated body, and coupled to the hinged lock assembly in the support yoke, so as to be angularly urged by the fastening point of the mobile part.

15. The device according to claim 11, in which the hinged lock assembly comprises a bent arm with one pan projecting from the support yoke, so as to be manually urged, for one of coupling and not coupling the arrangements of the disk and the hinged lock assembly.

16. The device according to claim 11, in which the arrangements of the disk comprise a nose projecting from a periphery of the disk for cooperating with a lever hinged to the elongated body so as to be directly urged by a system operably connected to a control automation for the leaf.

17. The device according to claim 10, in which the mobile part is coupled in the support yoke be a pin mounted in a slot.

18. The device according to claim 9, in which the means for providing temporary locking of the leaf is servocontrolled by a system operably connected to a control automation for the leaf.

* * * * *

UNITED STATES PATENT AND TRADEMARK OFFICE

CERTIFICATE OF CORRECTION

PATENT NO. : 5,394,651

DATED : March 7, 1995

INVENTOR(S) : Jean J. Vial

It is certified that error appears in the above-indentified patent and that said Letters Patent is hereby corrected as shown below:

Column 1, line 54, delete "dose" and substitute therefor --close--.

Column 4, 52, delete "fixing component" and substitute therfor --bracket--.
Column 4, line 63, before the word "body", insert --elongated--.
Column 6, line 12, delete "of".
Column 6, line 21, delete "connecting piece" and insert therefor --second bracket--.
Column 9, Claim 3, line 4, delete "leak" and insert therefor --leaf--.
Column 10, Claim 15, line 24, delete "pan" and substitute therefor --part--.

Signed and Sealed this

Twenty-second Day of October, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,394,651

DATED : March 7, 1995

INVENTOR(S) : Jean J. Vial

It is certified that error appears in the above-identified patent and that said Letters Patent is hereby corrected as shown below:

Column 4, line 51, before the word "body" insert --elongated--.

Signed and Sealed this

Ninth Day of December, 1997

*Attest:*

*Attesting Officer*

BRUCE LEHMAN

*Commissioner of Patents and Trademarks*